US011319733B2

(12) United States Patent
Scheuer et al.

(10) Patent No.: US 11,319,733 B2
(45) Date of Patent: May 3, 2022

(54) ELECTRONIC DOOR LATCHING SYSTEM FOR PREVENTING LOCK-OUT DURING AN ELECTRICAL POWER LOSS

(71) Applicant: GM Global Technology Operations LLC, Detroit, MI (US)

(72) Inventors: Jeffrey Scheuer, Macomb, MI (US); Jeffrey L. Konchan, Romeo, MI (US); Jeffrey R. Nowicki, Harrison Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 628 days.

(21) Appl. No.: 16/269,136

(22) Filed: Feb. 6, 2019

(65) Prior Publication Data

US 2020/0248490 A1 Aug. 6, 2020

(51) Int. Cl.

| | |
|---|---|
| ***E05B 81/80*** | (2014.01) |
| ***E05B 81/56*** | (2014.01) |
| ***E05B 81/12*** | (2014.01) |
| ***E05B 77/30*** | (2014.01) |
| ***E05B 81/20*** | (2014.01) |

(52) U.S. Cl.

CPC ..... *E05B 81/80* (2013.01); *E05B 77/30* (2013.01); *E05B 81/12* (2013.01); *E05B 81/20* (2013.01); *E05B 81/56* (2013.01)

(58) Field of Classification Search

CPC ..... E05B 81/82; E05B 81/80; E05B 81/90; E05B 81/20; E05B 81/64; E05B 77/28; E05B 17/226; E05B 77/00; E05B 81/00; E05B 81/68; E05B 81/12; E05B 77/30; E05B 81/56; G07C 2009/00634; G07C 2009/00642; G07C 2009/00587; G07C 9/00817

See application file for complete search history.

(56) References Cited

U.S. PATENT DOCUMENTS

| | | | | |
|---|---|---|---|---|
| 7,576,631 | B1 * | 8/2009 | Bingle | E05B 81/76 340/5.54 |
| 10,030,413 | B2 * | 7/2018 | Kamimura | E05B 85/16 |
| 10,227,810 | B2 * | 3/2019 | Linden | E05B 81/64 |
| 10,907,386 | B2 * | 2/2021 | Walawender | E05F 15/60 |
| 2008/0224482 | A1 * | 9/2008 | Gumbo | E05B 77/02 292/216 |

(Continued)

*Primary Examiner* — Mark A Williams

(74) *Attorney, Agent, or Firm* — Vivacqua Crane, PLLC

(57) ABSTRACT

An electronic door latching assembly for a side door of a vehicle is disclosed and includes a retaining member and an actuator. The actuator is operably connected to the retaining member and moves the retaining member between a primary position and an unlatched position. The electronic door latching assembly also includes a control module in electrical communication with the actuator. The control module executes instructions to: receive as input a power signal indicating that a loss of electrical power in the vehicle is imminent. After receiving the power signal, the control module receives a door open signal indicating that a door of the vehicle is being opened. In response to receiving the door open signal, the control module commands the actuator to rotate the retaining member from the unlatched position to the primary position where the side door is unable to latch shut.

20 Claims, 6 Drawing Sheets

(56) References Cited

U.S. PATENT DOCUMENTS

| | | | | |
|---|---|---|---|---|
| 2009/0145181 | A1* | 6/2009 | Pecoul | E05B 85/01 70/237 |
| 2014/0088825 | A1* | 3/2014 | Lange | E05B 81/14 701/36 |
| 2014/0347163 | A1* | 11/2014 | Banter | B60L 1/006 340/5.72 |
| 2015/0001926 | A1* | 1/2015 | Kageyama | E05B 81/86 307/10.1 |
| 2015/0330113 | A1* | 11/2015 | Van Wiemeersch | H04W 4/14 292/336.3 |
| 2016/0060909 | A1* | 3/2016 | Krishnan | E05B 81/86 292/194 |
| 2016/0145910 | A1* | 5/2016 | Beck | E05B 81/82 70/455 |
| 2016/0340940 | A1* | 11/2016 | Krishnan | G07C 9/00309 |

* cited by examiner

ELECTRONIC DOOR LATCHING SYSTEM FOR PREVENTING LOCK-OUT DURING AN ELECTRICAL POWER LOSS

INTRODUCTION

The present disclosure relates to electronic door latches for a vehicle. More particularly, the present disclosure relates to an electronic door latch that prevents a side door from latching shut during an electrical power loss to prevent a lock-out situation.

Many vehicles include side or passenger doors that are released by electronic door latches, or e-latches. Electronic door handles, which release an electronic door latch, may be integrated into a vehicle's beltline, which refers to the bottom edge of the side windows of the vehicle. Accordingly, electronic door handles tend to improve vehicle aesthetics by eliminating the mechanical door handles that are typically located along the exterior doors of a vehicle.

An electronic door latch requires electrical power to operate. The passenger doors of a vehicle also include a mechanical release lever that is accessible when a passenger is located within the interior cabin. The mechanical release lever may be manually actuated to unlatch the electric door latch. Therefore, in the event there is a loss of electrical power in the vehicle and the electronic door latches are unable to operate, a passenger may still exit the vehicle by manually actuating the mechanical release lever. For example, when there is a loss of electrical power due to a dead battery, a passenger may manually actuate the mechanical release lever, open the door, exit the vehicle, and then shut the passenger door. However, the passenger is now unable to re-open the passenger door since there are no mechanical door handles located along the exterior of the vehicle. Some vehicles include a key-actuated device that provides a backup mechanical-based approach to re-enter the vehicle when a lock-out situation occurs. Specifically, the key-actuated device allows for the passenger to re-enter the interior cabin of the vehicle manually when no electrical power is available. However, sometimes the passenger inadvertently leaves the key-actuated device in the interior cabin of the vehicle.

Thus, while current electronic door latches achieve their intended purpose, there is a need for a new and improved system and method for preventing a lock-out situation when there is a loss of electrical power in the vehicle.

SUMMARY

According to several aspects, an electronic door latching assembly for a side door of a vehicle is disclosed. The electronic door latching assembly includes a retaining member and an actuator, where the actuator is operably connected to the retaining member and moves the retaining member between a primary position and an unlatched position. The electronic door latching assembly also includes a control module in electrical communication with the actuator. The control module executes instructions to receive as input a power signal indicating that a loss of electrical power in the vehicle is imminent. After receiving the power signal, the control module executes instructions to receive a door open signal indicating that a door of the vehicle is being opened; In response to receiving the door open signal, the control module executes instructions to command the actuator to rotate the retaining member from the unlatched position to the primary position. The side door is unable to latch shut when the retaining member is in the primary position.

In one aspect, the electronic door latching assembly further comprises a display. In response to receiving the power signal, the control module executes instruction to instruct the display to show an override message, where the override message requests user input.

In another aspect, the control module executes instructions to receive the user input, where the user input indicates an override feature is not selected, and the override feature is configured to override the instructions commanding the actuator to shut the electronic door latching assembly.

In yet another aspect, the power signal indicates a battery voltage is below a threshold voltage.

In one aspect, the threshold voltage is representative of a minimum battery voltage required to move the retaining member from the primary position and into the unlatched position by the actuator.

In another aspect, the door open signal indicates a position of the retaining member.

In one aspect, the electronic door latching assembly for a vehicle is disclosed. The electronic door latching assembly is mounted on a side door of the vehicle and includes a retaining member configured to move between a primary position, a secondary position, and an unlatched position, where the retaining member is in the unlatched position when the side door is open and is in the primary position when the side door is latched shut. The electronic door latching assembly also includes one or more position sensors mounted on the retaining member. The position sensors indicate the retaining member is in one of the primary position, the secondary position, and the unlatched position. The electronic door latching assembly also includes an actuator operably connected to the retaining member, where the actuator is configured to move the retaining member between a primary position, a secondary position, and an unlatched position. The electronic door latching assembly also includes a control module in electrical communication with the actuator. The control module executes instructions to receive as input a power signal indicating that a loss of electrical power in the vehicle is imminent. After receiving the power signal, the control module further executes instructions to receive position signals from the position sensors, where the position signals indicate a position of the retaining member. The control module further executes instructions to determine the side door is being opened based on the position signals. In response to determining the side door is being opened, the control module executes instructions to command the actuator to shut the electronic door latching assembly by moving the retaining member from the unlatched position to the primary position, where the side door is unable to latch shut when the retaining member is in the primary position.

In one aspect, the electronic door latching assembly further includes a cable and a pulley. The cable connects the actuator to the pulley, and the pulley is operationally engaged with the retaining member.

In another aspect, the control module commands the actuator to shut the electronic door latching assembly by executing instructions to instruct the actuator to pull the cable in a first direction, where pulling the cable in the first direction causes the pulley to rotate in a first rotational direction.

In yet another aspect, rotation of the pulley in the first rotational direction urges the retaining member to rotate about a rotational axis in a second, opposite direction.

In one aspect, the retaining member defines a retaining arm and the pulley defines a pulley arm. The pulley arm is shaped to engage the retaining arm.

In another aspect, the retaining member is configured to rotate about an axis of rotation between the unlatched position and the primary position.

In yet another aspect, the electronic door latching assembly further includes a biasing member located around the axis of rotation of the biasing member.

In yet another aspect, the retaining member further defines a primary shoulder corresponding to the primary position and a secondary shoulder corresponding to the secondary position.

In one aspect, the electronic door latching assembly further includes a detent lever. The detent lever is configured to abut against the secondary shoulder of the retaining member when in the secondary position. The detent lever is configured to abut against the primary shoulder of the retaining member in the primary position.

In another aspect, the electronic door latching assembly further includes a display. In response to receiving the power signal, the control module executes instructions to instruct the display to show an override message, wherein the override message requests user input.

In yet another aspect, the control module executes instructions to receive the user input. The user input indicates an override feature is not selected. The override feature is configured to override the instructions commanding the actuator to shut the electronic door latching assembly.

In one aspect, the power signal indicates a battery voltage is below a threshold voltage.

In another aspect, the threshold voltage is representative of a minimum battery voltage required to move the retaining member from the primary position and into the unlatched position by the actuator.

In one aspect, the electronic door latching assembly for a vehicle is disclosed. The electronic door latching assembly is mounted on a side door of the vehicle and includes a retaining member configured to move between a primary position, a secondary position, and an unlatched position, where the retaining member is in the unlatched position when the side door is open and is in the primary position when the side door is latched shut. The electronic door latching assembly also includes one or more position sensors mounted on the retaining member. The position sensors indicate the retaining member is in one of the primary position, the secondary position, and the unlatched position. The electronic door latching system also includes a cable, a pulley operationally engaged with the retaining member, and an actuator. The actuator is operably connected to the retaining member and connected to the pully by the cable. The actuator is configured to move the retaining member between a primary position, a secondary position, and an unlatched position. The electronic door latching assembly also includes a control module in electrical communication with the actuator. The control module executes instructions to receive as input a power signal indicating that a loss of electrical power in the vehicle is imminent. After receiving the power signal, the control module further executes instructions to receive position signals from the position sensors, where the position signals indicate a position of the retaining member. The control module further executes instructions to determine the side door is being opened based on the position signals. In response to determining the side door is being opened, the control module executes instructions to command the actuator to shut the electronic door latching assembly by moving the retaining member from the unlatched position to the primary position, where the side door is unable to latch shut when the retaining member is in the primary position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
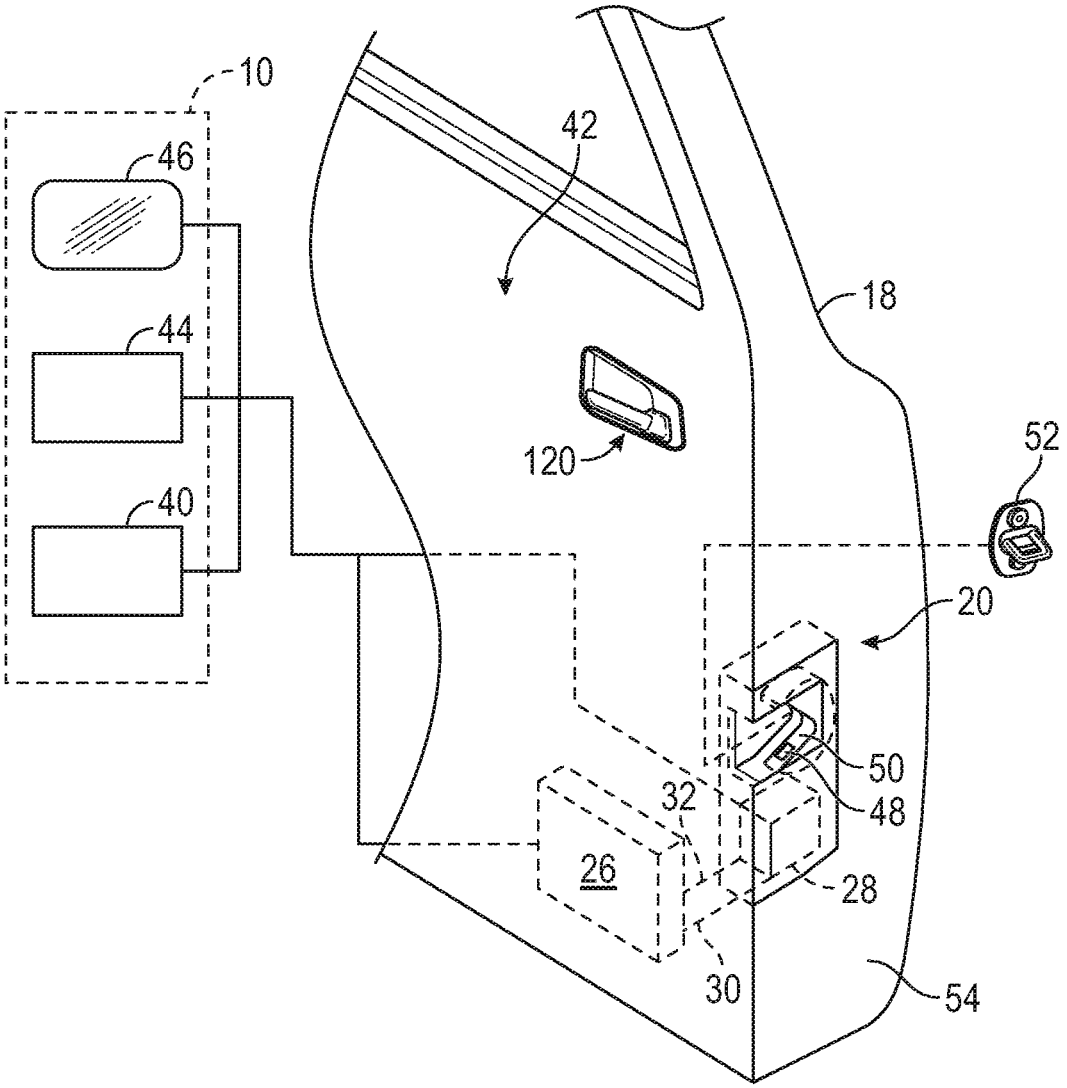
FIG. 1 is a schematic illustration of a vehicle, where the vehicle includes a side door having an electronic latching system, according to an exemplary embodiment.

Referring to FIG. 1, a schematic diagram of a vehicle 10 is shown. FIG. 1 also illustrates a passenger or side door 18 of the vehicle 10. The side door 18 may be a driver's side door, a front door, or a rear door of the vehicle 10. In the exemplary embodiment as shown, an electronic door latching assembly 20, which may also be referred to as an e-latch, is mounted upon the side door 18. The vehicle 10 may be an automobile such as, for example, a sedan, sport utility vehicle, or a van. However, it is to be appreciated the vehicle 10 is not limited to automobiles. Instead, the vehicle 10 may be any type of vehicle that includes doors that only include an electronic latch for entry into the vehicle 10. In other words, the electronic door latching assembly 20 may be utilized in any vehicle that does not include a mechanical release lever on the side door 18 for gaining access to the interior of the vehicle from the outside. For example, in another embodiment, the electronic door latching assembly 20 is part of a military vehicle.

The electronic door latching assembly 20 includes a control module 28 in communication with one or more actuators 26. Specifically, a cable 30 and a wire harness 32 are provided. The cable 30 operably connects the actuator 26 to the electronic door latching assembly 20. The actuator 26 is in electrical communication and receives instructions from the control module 28 of the electronic door latching assembly 20. Although a wiring harness 32 is shown, it is to be appreciated in another embodiment the actuator 26 is in electrical communication with the control module 28 based on a short-range wireless connection. The short-range wireless signal is any type of wireless signal for exchanging data over relatively short distances such as, for example, a Bluetooth® signal conforming to the Institute of Electrical and Electronics Engineers (IEEE) Standard 802.15 or a Wi-Fi® signal conforming to IEEE standard 802.11.

In the embodiment as illustrated in FIG. 1, the actuator 26 is mounted within an interior 42 of the side door 18. The control module 28 and the actuator 26 may also be in electrical communication and receive instructions from one or more control modules 40 of the vehicle 10. In one non-limiting embodiment, the control modules 40 may include a body control unit (BCU) or a door control unit (DCU). The vehicle 10 may also include a control module 44 in electrical communication with the control module 28, the control modules 40, and a display 46. In an embodiment, the display 46 is part of an infotainment system of the vehicle 10. The display 46 is configured to display text, graphs, and images based on instructions received from the control module 44.

The control modules 28, 40, and 44 are a non-generalized, electronic control device having one or more preprogrammed digital computers or processors, memory or non-transitory computer readable medium coupled to one or more processors used to store data such as control logic, instructions, image data, lookup tables, etc., and a plurality of input/output peripherals or ports. The processor of the control module is configured to execute the control logic or instructions.

The processor may operate under the control of an operating system that resides in memory. The operating system may manage computer resources so that computer program code embodied as one or more computer software applications, such as an application residing in memory, may have instructions executed by the processor. In an alternative embodiment, the processor may execute the application directly, in which case the operating system may be omitted. One or more data structures may also reside in memory, and may be used by the processor, operating system, or application to store or manipulate data.

The electronic door latching assembly 20 includes a retaining member 50 configured to engage with a striker 52 located along a corresponding door jamb (not visible in FIG. 1) of the vehicle 10. In one embodiment, the retaining member 50 is a fork bolt. It is to be appreciated that while FIG. 1 illustrates the electronic door latching assembly 20 along an inner surface 54 of the side door 18, in an alternative embodiment the striker 52 is located along the inner surface 54 of the side door 18 and the electronic door latching assembly is located along the door jamb instead.

As explained below, the actuator 26 is operably connected to the retaining member 50 and is configured to translate or move the retaining member 50 between a primary position, a secondary position, and an unlatched position. The primary position represents a fully latched position of the electronic door latching assembly 20, the secondary position represents a partially latched position of the electronic door latching assembly 20, and the unlatched position may also be referred to as an opened position. When the retaining member 50 is in the unlatched position, the side door 18 of the vehicle 10 is open.

One or more position sensors 48 are mounted upon the retaining member 50. For example, in one embodiment the position sensors 48 are microswitches. The position sensors 48 generate position signals indicating a position of the retaining member 50. The position signals are received as input by the control module 28 and the control modules 40. The control modules 28, 40 determine the position of the side door 18 based on the position signals received by the position sensors 48. Specifically, the control modules 28, 40 determine the side door 18 is open in response to the position signal indicating the retaining member 50 is in the unlatched position. The control modules 28, 40 further determine that the side door 18 is ajar in response to the position signal indicating the retaining member 50 is in the secondary position. The control modules 28, 40 also determine that the side door 18 is fully closed or latched shut in response to the position signals indicating the retaining member 50 is in the primary position.

Figure 2:
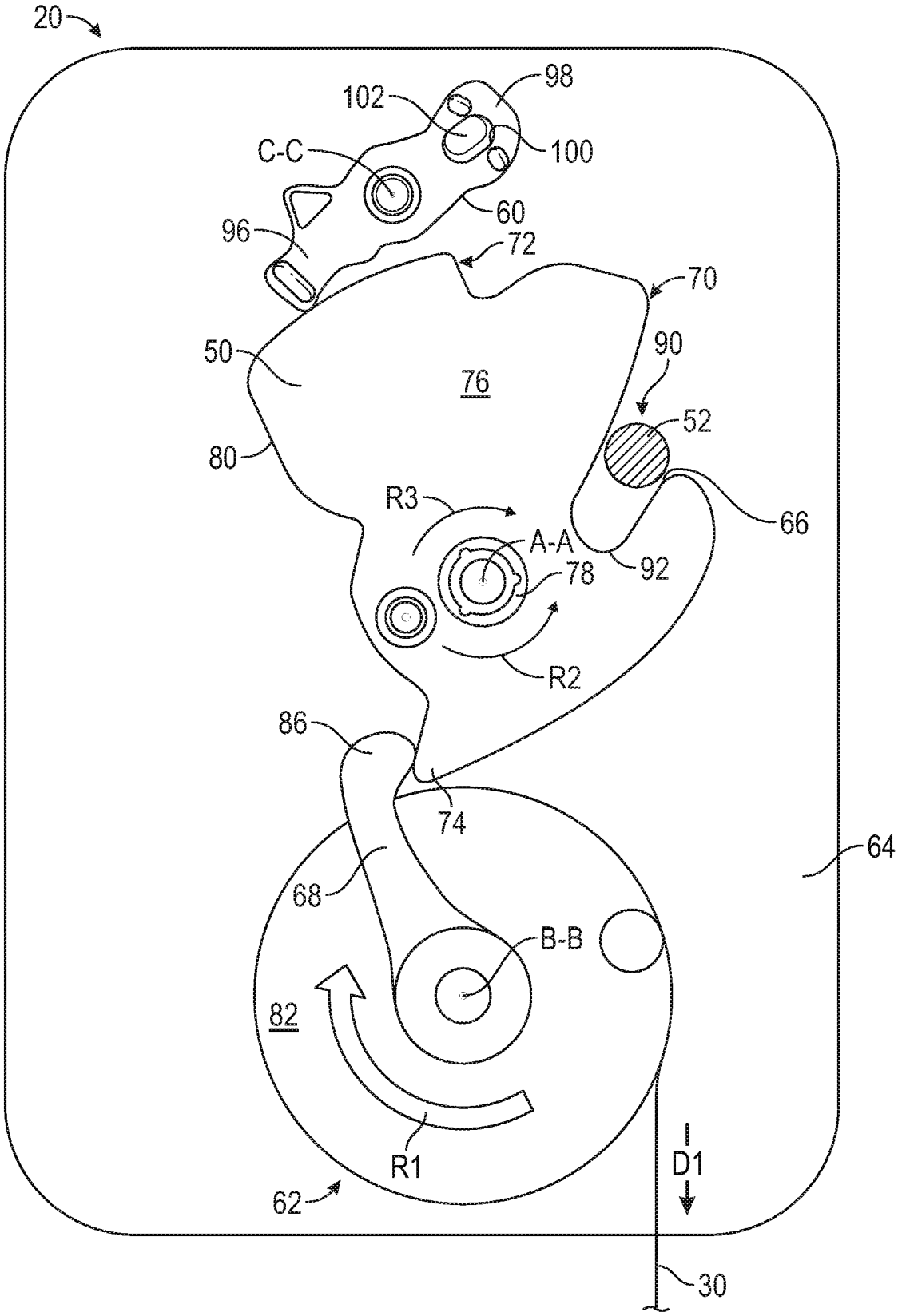
FIG. 2 is an illustration of the electronic door latching system shown in FIG. 1 in an unlatched position according to an exemplary embodiment.
Figure 3:
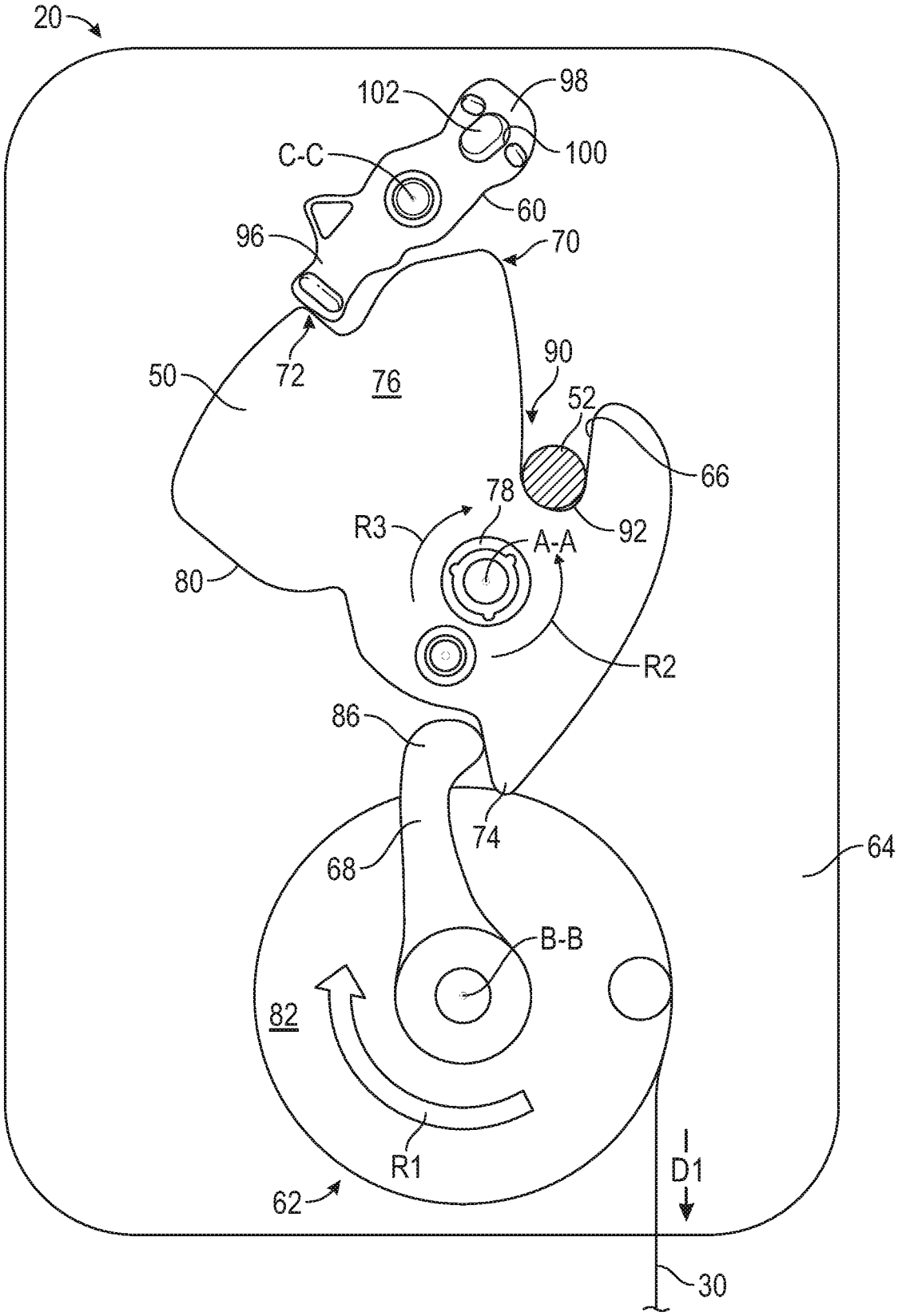
FIG. 3 is an illustration of the electronic door latching system shown in FIG. 1 in a secondary position according to an exemplary embodiment.
Figure 4:
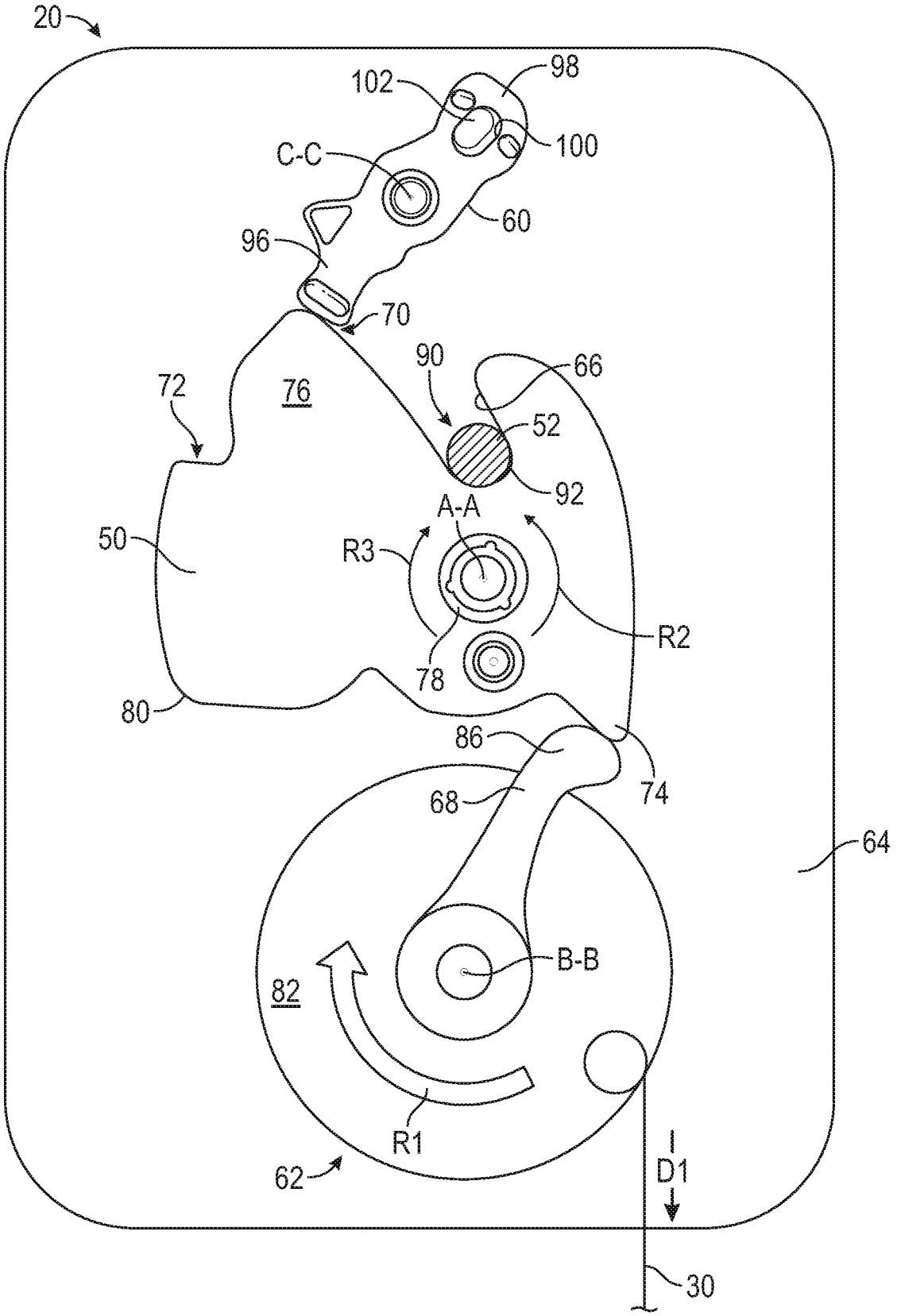
FIG. 4 is an illustration of the electronic door latching system shown in FIG. 1 in a primary position according to an exemplary embodiment.

FIG. 2 is an exemplary illustration of the electronic door latching assembly 20 shown in FIG. 1. The electronic door latching assembly includes the retaining member 50, a detent lever 60, and a pulley 62 that are each mounted upon a face plate 64. In the non-limiting embodiment as shown in FIG. 2, the retaining member 50 is illustrated as a fork bolt. The retaining member 50 is configured to move or rotate about a rotational axis A-A between the unlatched position as shown in FIG. 2, the secondary position (FIG. 3), and the primary position (FIG. 4). A biasing member 78 is located around the rotational axis A-A of the retaining member 50. In one non-limiting embodiment, the biasing member 78 may be a torsion spring. The biasing force is configured to exert a biasing force in a direction that is substantially perpendicular with respect to the rotational axis A-A of the retaining member 50.

Referring to both FIGS. 1 and 2, the pulley 62 is connected to the actuator 26 by the cable 30. Movement of the cable 30 in a first direction D1 creates rotation of the pulley in a first rotational direction R1 about a corresponding axis of rotation B-B. In the embodiment as shown, the first direction D1 is oriented downward and away from the pulley 62 and the first rotational direction R1 is in the clockwise direction, however, it is to be appreciated that the directions of movement as shown in the figures are exemplary. Furthermore, the components (i.e., the retaining member 50, the detent lever 60, etc.) as shown in FIGS. 2-4 are also exemplary in nature. Indeed, the structure of the electronic door latching assembly 20 is not limited to the embodiments as shown and may include other configurations as well.

The pulley 62 is engaged with the retaining member 50, where rotation of the pulley 62 in the first rotational direction R1 urges the retaining member 50 to rotate about the rotational axis A-A in an opposite direction, which is referred to a second rotational direction R2. In the embodiment as illustrated, the pulley 62 defines a pulley arm, which is referred to as arm 68. The arm 68 is shaped to engage or abut against a retaining arm, or arm 74, of the retaining member 50. However, it is to be appreciated that other devices may be used instead to operationally engage the pulley 62 with the retaining member 50 as well. The arm 68 of the pulley 62 rotates in concert with a body 82 of the pulley 62. Therefore, when the pulley 62 rotates in the first rotational direction R1, a distal end portion 86 of the arm 68 also rotates in the first rotational direction R1, and the arm 68 urges the arm 74 of the retaining member 50 to rotate in the second rotational direction R2.

Referring to FIGS. 2, 3, and 4, the retaining member 50 rotates about the rotational axis A-A in the second rotational direction R2 (which is counterclockwise) from the unlatched position (FIG. 2) and into either the secondary position (FIG. 3) or the primary position (FIG. 4), where the secondary position is located between the unlatched and the primary positions. A body 76 of the retaining member 50 defines a throat or slot 66. The slot 66 defines an elongated channel shaped to slidingly receive a portion of the striker 52 as the retaining member 50 is rotated about the rotational axis A-A from the unlatched position and into either the primary position or the secondary position. The body 76 of the retaining member 50 also defines a primary shoulder 70, a secondary shoulder 72, and the arm 74. The slot 66, the primary shoulder 70, the secondary shoulder 72, and the arm 74 are each located along an outer periphery 80 of the body 76 of the retaining member 50.

The slot 66 of the retaining member 50 includes a first open end 90 and a second closed end 92, where the slot 66 terminates at both ends 90, 92. When the electronic door latching assembly 20 is in the unlatched position, the striker 52 is located at the first open end 90 of the slot 66. Turning to FIGS. 3 and 4, when the electronic door latching assembly 20 is in the secondary position or the primary position, the striker 52 is located in the slot 66, and in one embodiment may abut against the second closed end 92 of the slot 66.

The detent lever 60 is rotatable about an axis of rotation C-C between the unlatched position, the secondary position, and the primary position. The detent lever 60 includes a first end portion 96 and a second end portion 98. In the non-limiting embodiment as shown, the axis of rotation C-C is located between the first end portion 96 and the second end portion 98 of the detent lever 60. In an embodiment, the detent lever 60 may also include a slotted aperture 100 located on the second end portion 98 that is shaped to receive a guide pin 102. When the electronic door latching assembly 20 is in the unlatched position, the first end portion 96 of the detent lever 60 abuts against the outer periphery 80 of the retaining member 50.

Referring specifically to FIG. 3, when the electronic door latching assembly 20 is in the secondary position, the first end portion 96 of the detent lever 60 abuts against the secondary shoulder 72 of the retaining member 50. Referring now to FIG. 4, when the electronic door latching assembly 20 is in the primary position, the first end portion 96 of the detent lever 60 abuts against the primary shoulder 70 of the retaining member 50.

Referring generally to FIGS. 1-4, when a passenger opens the side door 18 of the vehicle 10 (FIG. 1) by unlatching the electronic door latching assembly 20, the striker 52 may urge the retaining member 50 from the primary position (FIG. 4) and into the unlatched position (FIG. 2). When a passenger closes the side door 18 of the vehicle 10, the striker 52 may urge the retaining member 50 from the unlatched position as seen in FIG. 2 into the secondary position or the primary position. Specifically, if a passenger does not close the side door 18 with a sufficient force, then the side door 18 may still be ajar and in the secondary position. In an embodiment, the actuator 26 drives the pulley 62 in the first rotational direction R1 to rotate the retaining member 50 into the primary position.

In another approach, when the side door 18 is unlatched, the detent lever 60 is lifted by an actuator (not illustrated). Specifically, the detent lever 60 is normally biased in a latched position (i.e. the primary position as seen in FIG. 4). In response to receiving signals from the actuator, the detent lever 60 is lifted out of the position seen in FIG. 4 and rotates about the axis C-C. The biasing member 78 located around the rotational axis A-A of the retaining member 50 exerts the biasing force in a third rotational direction R3 (which is opposite to the direction in which the retaining member 50 rotates to latch shut) to urge the retaining member 50 from either the primary or the secondary positions and into the unlatched position.

Figure 5:
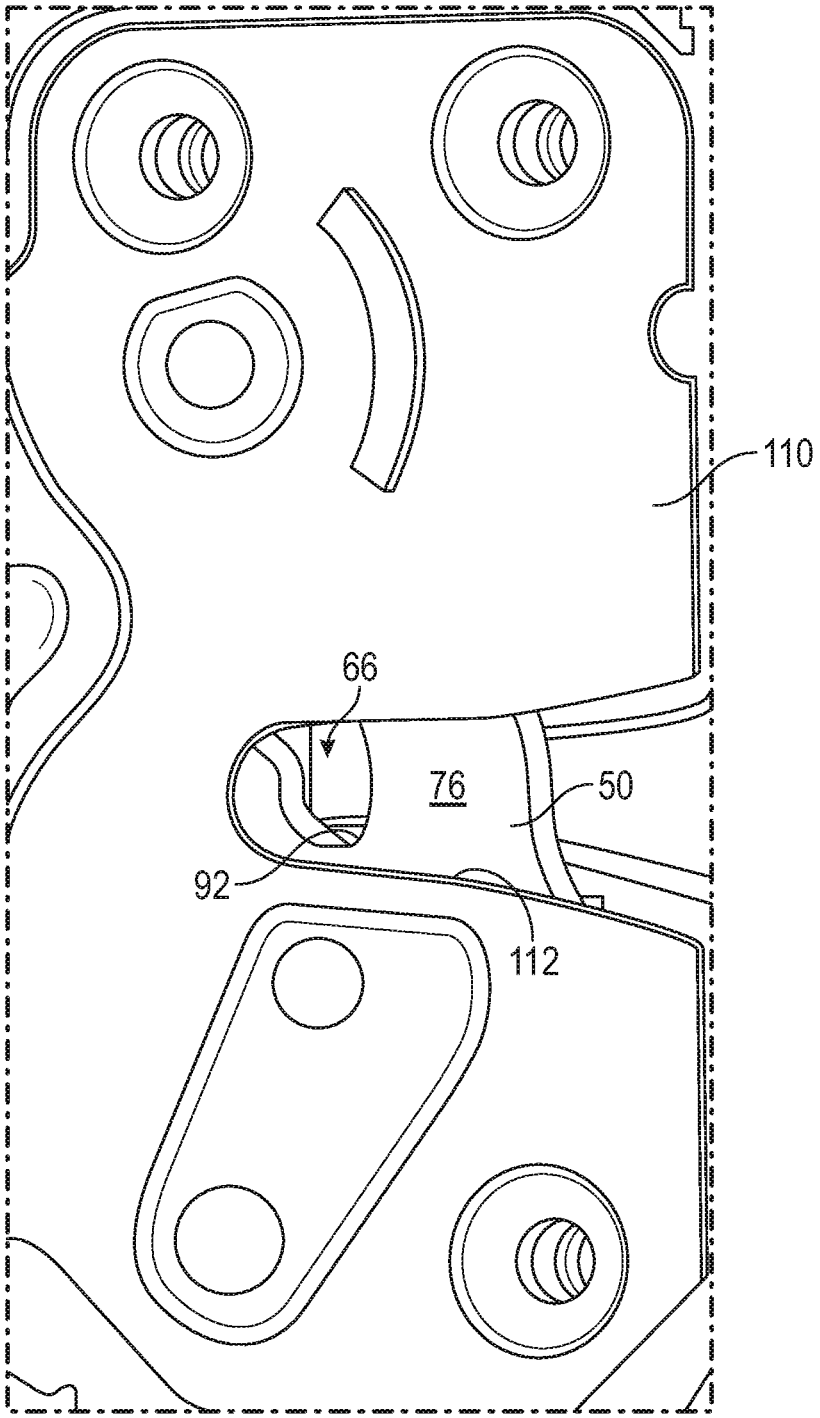
FIG. 5 is a perspective view of the electronic door latching system in the primary position that is partially covered by a plate in the side door of the vehicle according to an exemplary embodiment.

FIG. 5 is an illustration of a side panel 110 covering a majority of the electronic door latching assembly. However, a portion of the retaining member 50 is still visible through a slot 112 located in the side panel 110. Specifically, the second closed end 92 of the slot 66 is still visible. In the embodiment as shown in FIG. 5, the retaining member 50 is in the primary position. It is to be appreciated that when the retaining member 50 is in the primary position the body 76 of the retaining member 50 creates an obstruction, and thereby blocks or prevents the striker 52 from moving the retaining member 50. That is, the striker 52 actually makes impact with or hits the body 76 of the retaining member 50. Therefore, the side door 18 of the vehicle 10 (FIG. 1) is unable to latch shut.

Referring to FIGS. 1, 2, and 5, the electronic door latching assembly 20 provides an approach for preventing the side door 18 from latching shut during a loss of electrical power in the vehicle 10 to avoid a lock-out situation. Specifically, during a loss of electrical power, the control module 28 first determines that the side door 18 of the vehicle 10 has opened. More specifically, the side door 18 is opened when a passenger exits the vehicle 10 by manually actuating a mechanical release lever 120 (seen in FIG. 1) on an interior portion of the side door 18. Once the side door 18 opens, the control module 28 commands the actuator 26 to rotate the retaining member 50 from the unlatched position (FIG. 2) and into the primary position as seen in FIG. 5, where the side door 18 is unable to latch shut. As mentioned above, the side door 18 does not include mechanical release levers that may be accessed from outside. Therefore, this approach prevents a lock-out condition where the passenger may not re-enter the vehicle 10 by manually opening the side door 18.

When the vehicle 10 is operating, sometimes a loss of electrical power is imminent. For example, an imminent loss of power in a vehicle may indicate that the battery is dying. Specifically, in one example, the loss of electrical power is imminent if the battery voltage is less than about nine volts for about one second. Alternatively, in another non-limiting example, the loss of electrical power is imminent if the battery voltage drops two or more volts in about two seconds. The control modules 28, 44 receive as input a power signal indicating a loss of electrical power in the vehicle is imminent. The power signal may be sent from one of the control modules 40 of the vehicle 10 such as, for example, the BCU or, alternatively, by a sensor. In one embodiment, the power signal indicates a battery voltage is below a threshold voltage. The threshold voltage is representative of a minimum battery voltage required to move the retaining member 50 from the primary position and into the unlatched position by the actuator 26. For example, in one embodiment the threshold voltage is about nine volts.

In response to receiving the power signal, the control module 44 instructs the display 46 to show an override message requesting user input. The override message asks the passengers of the vehicle 10 if they wish to disable the lock-out feature. That is, the override message is configured to override the instructions executed by the control module 28 commanding the actuator 26 to cinch or otherwise latch the electronic door latching assembly 20 shut. The passenger may then create a user input by either selecting or dismissing the override message. The passenger may create the user input based on a variety of approaches such as, for example, voice activated control, touchscreen input, or by selecting a knob or button.

If the override message is not selected, then the control module 28 may proceed to shut the electronic door latching assembly 20. Specifically, after receiving the power signal, the control module 28 receives a door open signal indicating that the side door 18 of the vehicle 10 is being opened. In one embodiment, the door open signal is generated by the position sensors 48 mounted upon the retaining member 50 (FIG. 1). The position signal generated by the position sensors 48 indicating a position of the retaining member 50 is the door open signal. In response to receiving the door open signal, the control module 28 commands the actuator 26 to shut the electronic door latching assembly 20 by rotating the retaining member 50 from the unlatched position to the primary position in FIG. 5. The electronic door latching assembly 20 remains shut until electrical power is restored. In one embodiment the control module 28 resets the electronic door latching assembly 20 in response to receiving an indicating that the battery is sufficient charged.

Figure 6:
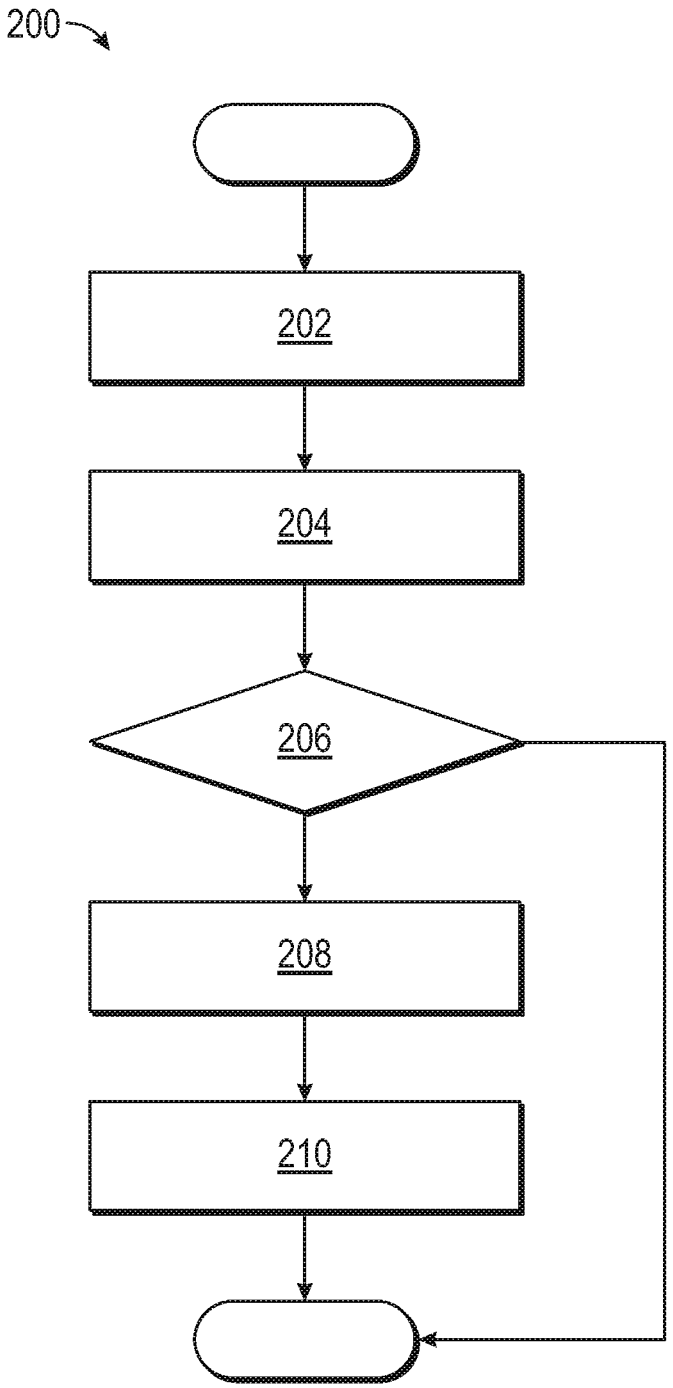
FIG. 6 is a process flow diagram illustrating a method for operating the electronic door latching assembly in the event there is a loss of electrical power in the vehicle according to an exemplary embodiment.

FIG. 6 is an exemplary process flow diagram illustrating a method 200 for latching the side door 18 shut to prevent a lock-out situation when there is a loss of electrical power in the vehicle 10. Referring generally to the figures, the method 200 may begin at block 202. In block 202, the control module 28 receives the power signal indicating that a loss of electrical power in the vehicle 10 is imminent. As mentioned above, in one exemplary embodiment the power signal indicates that the battery voltage is below a threshold voltage of about nine volts. The method 200 may then proceed to block 204.

In block 204, the control module 44 instructs the display 46 to show the override message requesting user input. The override message asks the passengers of the vehicle 10 if they wish to disable the lock-out feature. The method 200 may then proceed to decision block 206.

In decision block 206, if the passengers create a user input indicating they want to disable the lock-out feature by selecting the override message, then no further action is taken. The method 200 may then terminate. However, if the user input indicates the override feature is not selected by the passengers, then the method 200 may proceed to block 208.

In block 208, the control module 28 receives the door open signal indicating that the side door 18 of the vehicle 10 is being opened. As mentioned above, in one embodiment the control module 28 determines the side door 18 is being opened based on the position signals generated by the position sensors 48 mounted on the retaining member 50. The method 200 may then proceed to block 210.

In block 210, the control module 28 commands the actuator 26 to shut the electronic door latching assembly 20 by rotating the retaining member 50 from the unlatched position to the primary position as seen in FIG. 5. Therefore, the side door 18 is now unable to latch shut. The method 200 may then terminate.

Technical effects and benefits of the disclosed electronic door latching system include a cost-effective and efficient solution for preventing a lock-out situation when there is a loss of electrical power in a vehicle having electronic door latching assemblies, but with no manual release levers on the outside of the side doors. Specifically, the disclosure address a lock-out situation when there is a loss of electrical power and the passenger inadvertently leaves a backup key-actuated device in the interior cabin of the vehicle.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An electronic door latching assembly for a side door of a vehicle, comprising:

a striker;

a retaining member configured to engage with the striker when the side door of the vehicle is latched shut, wherein the retaining member is rotatable about a rotational axis from an unlatched position where the side door of the vehicle is unlatched to a primary position where the side door of the vehicle is latched shut, and wherein the striker urges the retaining member from the primary position into the unlatched position when the side door is opened by a passenger of the vehicle;

an actuator is operably connected to the retaining member for rotating the retaining member between the primary position and the unlatched position; and a control module in electrical communication with the actuator, wherein the control module executes instructions to:

receive as input a power signal indicating that a loss of electrical power in the vehicle is imminent from either a sensor or another control module that is part of the vehicle;

after receiving the power signal, receive a door open signal indicating that a door of the vehicle is being opened; and in response to receiving the door open signal, command the actuator to rotate the retaining member about the rotational axis from the unlatched position to the primary position and the striker impacts the retaining member as the side door being is shut so the striker is unable to engage with the retaining member and the side door is unable to latch shut by the passenger of the vehicle.

2. The electronic door latching assembly of claim 1, further comprising a display for showing text, graphics, and images, wherein the display is in electronic communication with the control module, and wherein the control module further executes instructions to:

in response to receiving the power signal, instruct the display to show an override message, wherein the override message requests user input from the passenger of the vehicle.

3. The electronic door latching assembly of claim 2, wherein the control module executes instructions to:

receive the user input, wherein the user input indicates an override feature is dismissed by the passenger, wherein the override feature is configured to override the instructions commanding the actuator to shut the electronic door latching assembly.

4. The electronic door latching assembly of claim 3, wherein the power signal indicates a battery voltage is below a threshold voltage.

5. The electronic door latching assembly of claim 4, wherein the threshold voltage is representative of a minimum battery voltage required to move the retaining member from the primary position and into the unlatched position by the actuator.

6. The electronic door latching assembly of claim 1, wherein the door open signal indicates the retaining member is in either the primary position or the unlatched position.

7. The electronic door latching assembly of claim 1, wherein the retaining member is a fork bolt.

8. An electronic door latching assembly for a vehicle, wherein the electronic door latching assembly is mounted on a side door of the vehicle, the electronic door latching assembly comprising:

a striker;

a retaining member configured to engage with the striker when the side door of the vehicle is latched shut, wherein the retaining member is rotatable about a rotational axis between a primary position, a secondary position, and an unlatched position, wherein the retaining member is in the unlatched position when the side door is open and is in the primary position when the side door is latched shut, and wherein the striker urges the retaining member from the primary position into the unlatched position when the side door is opened by a passenger of the vehicle;

one or more position sensors mounted on the retaining member, wherein the position sensors indicate the retaining member is in one of the primary position, the secondary position, and the unlatched position;

an actuator operably connected to the retaining member, wherein the actuator is configured to rotate the retaining member between the primary position, the secondary position, and the unlatched position; and a control module in electrical communication with the actuator, wherein the control module executes instructions to:

receive as input a power signal indicating that a loss of electrical power in the vehicle is imminent from either a sensor or another control module that is part of the vehicle;

after receiving the power signal, receive position signals from the position sensors, wherein the position signals indicate the retaining member is in either the primary position or the unlatched position;

determine the side door is being opened based on the position signals; and in response to determining the side door is being opened, command the actuator to rotate the retaining member from the unlatched position to the primary position and the striker impacts the retaining member as the side door being is shut so the striker is unable to engage with the retaining member and the side door is unable to latch shut by the passenger of the vehicle.

9. The electronic door latching assembly of claim 8, further comprising a cable and a pulley, wherein the cable connects the actuator to the pulley, and the pulley is operationally engaged with the retaining member.

10. The electronic door latching assembly of claim 9, wherein the control module commands the actuator to shut the electronic door latching assembly by executing instructions to:

instruct the actuator to pull the cable in a first direction, wherein pulling the cable in the first direction causes the pulley to rotate in a first rotational direction.

11. The electronic door latching assembly of claim 10, where rotation of the pulley in the first rotational direction urges the retaining member to rotate about a rotational axis in a second, opposite direction.

12. The electronic door latching assembly of claim 9, wherein the retaining member defines a retaining arm and the pulley defines a pulley arm, and wherein the pulley arm is shaped to engage the retaining arm.

13. The electronic door latching assembly of claim 8, further comprising a biasing member located around the axis of rotation.

14. The electronic door latching assembly of claim 8, wherein the retaining member further defines a primary shoulder corresponding to the primary position and a secondary shoulder corresponding to the secondary position.

15. The electronic door latching assembly of claim 14, further comprising a detent lever, wherein the detent lever is configured to abut against the secondary shoulder of the retaining member when in the secondary position, and wherein the detent lever is configured to abut against the primary shoulder of the retaining member in the primary position.

16. The electronic door latching assembly of claim 8, further comprising a display for showing text, graphics, and images, wherein the display is in electronic communication with the control module, wherein the control module further executes instructions to:

in response to receiving the power signal, instruct the display to show an override message, wherein the override message requests user input from the passenger of the vehicle.

17. The electronic door latching assembly of claim 16, wherein the control module executes instructions to:

receive the user input, wherein the user input indicates an override feature is dismissed by the passenger, wherein the override feature is configured to override the instructions commanding the actuator to shut the electronic door latching assembly.

18. The electronic door latching assembly of claim 17, wherein the power signal indicates a battery voltage is below a threshold voltage.

19. The electronic door latching assembly of claim 18, wherein the threshold voltage is representative of a minimum battery voltage required to move the retaining member from the primary position and into the unlatched position by the actuator.

20. An electronic door latching assembly for a vehicle, wherein the electronic door latching assembly is mounted on a side door of the vehicle, the electronic door latching assembly comprising:

a striker;

a retaining member configured to engage with the striker when the side door of the vehicle is latched shut, wherein the retaining member is rotatable about a rotational axis between a primary position, a secondary position, and an unlatched position, wherein the retaining member is in the unlatched position when the side door is open and is in the primary position when the side door is latched shut, and wherein the striker urges the retaining member from the primary position into the unlatched position when the side door is opened by a passenger of the vehicle;

one or more position sensors mounted on the retaining member, wherein the position sensors indicate the retaining member is in one of the primary position, the secondary position, and the unlatched position;

a cable;

a pulley operationally engaged with the retaining member;

an actuator operably connected to the retaining member and connected to the pulley by the cable, wherein the actuator is configured to rotate the retaining member between the primary position, the secondary position, and the unlatched position; and a control module in electrical communication with the actuator, wherein the control module executes instructions to:

receive as input a power signal indicating that a loss of electrical power in the vehicle is imminent from either a sensor or another control module that is part of the vehicle;

after receiving the power signal, receive position signals from the position sensors, wherein the position signals indicate the retaining member is in either the primary position or the unlatched position;

determine the side door is being opened based on the position signals; and in response to determining the side door is being opened, command the actuator to rotate the retaining member from the unlatched position to the primary position and the striker impacts the retaining member as the side door being is shut so the striker is unable to engage with the retaining member and the side door is unable to latch shut by the passenger of the vehicle.

* * * * *